US007432904B2

(12) United States Patent
Kang

(10) Patent No.: US 7,432,904 B2
(45) Date of Patent: Oct. 7, 2008

(54) LIQUID CRYSTAL DISPLAY DEVICE HAVING A SOURCE DRIVER AND A REPAIR AMPLIFIER

(75) Inventor: Chang-Sig Kang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 607 days.

(21) Appl. No.: 11/038,358

(22) Filed: Jan. 19, 2005

(65) Prior Publication Data

US 2005/0174316 A1 Aug. 11, 2005

(30) Foreign Application Priority Data

Feb. 9, 2004 (KR) ..... 10-2004-0008253

(51) Int. Cl.
*G09G 3/36* (2006.01)
*G09G 3/18* (2006.01)
*G09G 3/20* (2006.01)

(52) U.S. Cl. ..... 345/98; 349/54; 349/55

(58) Field of Classification Search ..... 345/98, 345/96, 204; 349/54, 55
See application file for complete search history.

(56) References Cited

U.S. PATENT DOCUMENTS 6,525,705 B1 * 2/2003 Ishii et al. ..... 345/87
6,639,634 B1 * 10/2003 Zhang et al. ..... 349/54
6,753,935 B2 * 6/2004 Wu ..... 349/54
6,819,370 B2 * 11/2004 Sah et al. ..... 349/54
6,867,823 B2 * 3/2005 Hong et al. ..... 349/54
2002/0003590 A1 * 1/2002 Ko et al. ..... 349/54
2003/0080934 A1 * 5/2003 Ishiyama ..... 345/100
2005/0110738 A1 * 5/2005 Kim et al. ..... 345/100

FOREIGN PATENT DOCUMENTS

| | | |
|---|---|---|
| JP | 8171081 | 7/1996 |
| JP | 02023132 | 1/2002 |
| KR | 98070572 | 10/1998 |
| KR | 000000788 | 1/2000 |

OTHER PUBLICATIONS

English Abstract***.

* cited by examiner

*Primary Examiner*—Amare Mengistu
*Assistant Examiner*—Elijah M Sheets
(74) *Attorney, Agent, or Firm*—F. Chau & Assoc., LLC

(57) ABSTRACT

There is provided a source driver having a repair amplifier and method of processing signals. There is also provided a liquid crystal display device containing the source driver. The source driver drives adjacent source lines with source line driving signals. The repair amplifier amplifies the source line driving signal to drive a part of a source line.

20 Claims, 5 Drawing Sheets

LIQUID CRYSTAL DISPLAY DEVICE HAVING A SOURCE DRIVER AND A REPAIR AMPLIFIER

CROSS-REFERENCE TO RELATED APPLICATION

This application claims the priority of Korean Patent Application No. 10-2004-0008253, filed on Feb. 9, 2004, in the Korean Intellectual Property. Office, the disclosure of which is incorporated herein in its entirety by reference.

BACKGROUND OF THE INVENTION

1. Technical Field

The present invention relates to a liquid crystal display device, and more specifically, to a source driver having a repair amplifier and a liquid crystal display device comprising the source driver.

2. Discussion of the Related Art

Liquid crystal display devices have merits such as decreased size, decreased thickness and lower power consumption over other types of display devices. They have been used for various types of electronic equipment such as notebook computers, office automation equipment and audio/video equipment. Specifically, active matrix type liquid crystal display devices, employing thin film transistors as switch elements, are suitable for displaying moving images.

FIG. 1 is a block diagram schematically illustrating a conventional liquid crystal display device. The conventional liquid crystal display device 100 comprises a source driver 110, a liquid crystal panel 160, a first fuse (F) 171 and a second fuse (F) 172.

The source driver 110 comprises digital-to-analog converters (DAC) 120, normal amplifiers 130, an output detection circuit 140 and a repair amplifier 150.

A plurality of digital-to-analog converters 120 and a plurality of normal amplifiers 130 are provided in the source driver 110. Source line driving signals, which are outputs of the normal amplifiers 130, are also output from the source driver 110. Each source line driving signal is represented by the reference numeral $Y_n$. The source line driving signals $Y_n$ are generated by an inverted signal of a polarity control signal POL, and are inverted signals of an n-th source line driving signal $Y_n$.

Each DAC 120 converts a digital image signal D_DAT into analog image signals, VP and VN, and outputs the converted signal. The analog image signals VP and VN indicate a gray level voltage.

Each normal amplifier 130 amplifies the analog image signals VP and VN in response to the polarity control signal POL and generates the source line driving signal $Y_n$, which drives source line $SL_n$ of the liquid crystal panel 160. The polarity control signal POL is a signal controlling the polarity of liquid crystal and is to be inverted every frame so as to prevent deterioration of the liquid crystal panel 160. Each normal amplifier 130 can be implemented as a single amplifier or a rail-to-rail amplifier.

When an open circuit defect (indicated by the letter A in the figure) is generated in one of the source lines $SL_n$, which can be due to errors made during the manufactur of the liquid crystal panel 160, the first and second fuses 171 and 172 can be melted with a laser to connect the metal lines arranged at both ends of the first and second fuses 171 and 172.

The output detection circuit 140 generates a detection signal DET, in response to the source line driving signal $Y_n$, that is applied when the metal lines at both ends of the first fuse 171 are connected by a laser. For example, when the voltage level of the source line driving signal $Y_n$ ranges between VDD/2 and VDD, which is hereinafter referred to as a positive voltage, the output detection circuit 140 generates the detection signal DET of a high level. Similarly, when the voltage level of the source line driving signal $Y_n$ ranges between VSS and VDD/2, which is hereinafter referred to as a negative voltage, the output detection circuit 140 generates the detection signal DET of a low level. The output detection circuit 140 can be implemented as an operational amplifier, wherein a reference voltage applied to the inverting input terminal of the operational amplifier may be VDD/2.

The repair amplifier 150 amplifies the source line driving signal $Y_n$ transmitted through the first melted fuse 171, in response to the detection signal DET and generates a repair source line driving signal $Y_n$_R. The repair source line driving signal $Y_n$_R drives, through a repair line RL, a part of the source line $SL_n$ that is not driven due to an open-circuit defect A.

The liquid crystal panel 160 comprises a plurality of pixels 161. Each pixel 161 has a switch transistor TR and a liquid crystal capacitor CLC. The switch transistor TR is turned on or turned off in response to a signal driving a gate line GL. One end of the switch transistor TR is connected to source lines $SL_n$. The liquid crystal capacitor CLC is connected between the other end of the switch transistor TR and a common voltage VCOM. The common voltage VCOM can be VDD/2.

FIG. 2 is a circuit diagram illustrating an example of the repair amplifier shown in FIG. 1. Referring to FIG. 2, the repair amplifier 150 has switch circuits (151, 153, 154 and 156) and amplifiers (152 and 155). The two amplifiers 152 and 155 constitute a single amplifier.

Each switch circuit 151, 153, 154 and 156 includes an inverter and a transmission gate. Each switch circuit 151, 153, 154 and 156 is turned on or turned off in response to the detection signal DET.

Each amplifier 152 and 155 can be implemented with an operational amplifier configured as a voltage follower. The first amplifier 152 amplifies a positive voltage of the source line driving signal $Y_n$, transmitted when the detection signal DET has a high level, and supplies the amplified positive voltage to the repair source line driving signal $Y_n$_R. The second amplifier 155 amplifies a negative voltage of the source line driving signal $Y_n$, transmitted when the detection signal. DET has a low level, and supplies the amplified negative voltage to the repair source line driving signal $Y_n$_R.

Since the conventional source driver 110 of a liquid crystal display device comprises the output detection circuit 140 implemented with an operational amplifier, which is an analog circuit, power consumption can be high due to consumption of standby current, etc. In addition, generation of the repair source line driving signal $Y_n$_R can be delayed due to resistor-capacitor (RC) delay of the output detection circuit 140.

SUMMARY OF THE INVENTION

According to an exemplary embodiment of the present invention, there is provided a source driver of a liquid crystal display device that drives adjacent source lines with source line driving signals having a mutually inverted phase relationship. The source driver has a normal amplifier that amplifies an analog image signal, and generates the source line driving signal driving one of the source lines in response to a polarity control signal. There is also a repair amplifier that, when connected to the source line driving signal, amplifies the source line driving signal in response to the polarity control signal. It is then used to generate a repair source line driving signal that drives a repair line. The repair line can be connected to a part of the source line that is not driven by the source line driving signal due to a of the source line.

In another exemplary embodiment of the present invention the source driver may further comprise a logic circuit that generates a switch signal and an inverted signal of the switch signal allowing a repair source line driving signal to be generated as an output of the repair amplifier in response to the polarity control signal and an external control signal. The phase of the switch signal may be equal or opposite to the phase of the polarity control signal in response to a logic state of the external control signal.

In another exemplary embodiment of the present invention the phase of the switch signal may be equal to the phase of the polarity control signal when the external control signal has a logic low level. The phase of the switch signal may be opposite to the phase of the polarity control signal when the external control signal has a logic high level. The repair source line driving signals can be generated to have a phase opposite to that of the switch signal.

In another exemplary embodiment of the present invention the repair amplifier may comprise a charging amplifier that amplifies a positive voltage of the source line driving signal and supplies the amplified positive voltage to the repair source line driving signal; and a discharging amplifier that amplifies a negative voltage of the source line driving signal and supplies the amplified negative voltage to the repair source line driving signal.

In another exemplary embodiment of the present invention the repair amplifier may further comprise: a first switch circuit that transmits the positive voltage of the source line driving signal to an input terminal of the charging amplifier in response to the switch signal; a second switch circuit that supplies the positive voltage amplified by the charging amplifier to the repair source line driving signal in response to the switch signal; a third switch circuit that transmits the negative voltage of the source line driving signal to an input terminal of the discharging amplifier in response to the inverted signal of the switch signal; and a fourth switch circuit that supplies the negative voltage of the source line driving signal amplified by the discharging amplifier to the source line driving signal in response to the inverted signal of the switch signal.

In another exemplary embodiment of the present invention the logic circuit may comprise an exclusive OR gate that generates the switch signal in response to the polarity control signal and the external control signal, and an inverter that inverts the switch signal to generate the inverted signal of the switch signal.

In another exemplary embodiment of the present invention the normal amplifier may comprise a charging amplifier that amplifies a positive voltage of the analog image signal, and a discharging amplifier that amplifies a negative voltage of the analog image signal. A first switch circuit that supplies the amplified positive voltage to the source line driving signal in response to the polarity control signal, and a second switch circuit that supplies the amplified negative voltage to the source line driving signal in response to the polarity control signal.

In an exemplary embodiment of the present invention the repair amplifier comprises a single amplifier.

According to another exemplary embodiment of the present invention, there is provided a liquid crystal display device including a liquid crystal panel having a plurality of pixels connected to a plurality of source lines. There is also included a source driver that produces a plurality of source line driving signals to drive the plurality of source lines so that adjacent source lines are driven with the source line driving signals having a mutually inverted phase relationship. The source driver comprises a repair amplifier that, when connected to one of the plurality of source line driving signals that drives a defective one of the plurality of source lines and the defective source line, drives the pixels connected to a part of the defective source line that is not driven by the one of the source line driving signals. The repair amplifier is controlled by a polarity control signal controlling a polarity inversion of a liquid crystal corresponding to one of the pixels.

In another exemplary embodiment of the present invention there is provided a method of driving a liquid crystal panel using adjacent source lines and source line driving signals that have a mutually inverted phase relationship. The method steps comprise providing a source line driving signal that drives a source line, and processing the source line driving signal, in response to a polarity control signal, to generate a repair source line driving signal that is used to drive a part of the source line. This part of the source line is not being driven by the source line driving signal due to a defect of the source line.

In another exemplary embodiment of the present invention the processing of the source line driving signal comprises the method steps of receiving a switch signal and an inverted signal of the switch signal; the switch signal having been generated in response to the polarity control signal and an external control signal, so that the phase of the switch signal is equal or opposite to the phase of the polarity control signal in response to a logic state of the external control signal; and processing the source line driving signal, in response to the switch signal and the inverted signal of the switch signal, whereby the source line driving signal is processed in response to the polarity control signal.

In another exemplary embodiment of the present invention the switch signal is generated using explosive OR logic to process the polarity control signal and the external control signal.

In another exemplary embodiment of the present invention the step of processing the source line driving signal comprises amplifying a positive portion of the source line driving signal; amplifying a negative portion of the source line driving signal; and combining the amplified positive and negative portions to generate the repair source line driving signal.

In another exemplary embodiment of the present invention the step of providing a source line driving signal comprises amplifying an analog image signal in response to a polarity control signal and outputting the source line driving signal.

In another exemplary embodiment of the present invention the step of amplifying an analog image signal comprises receiving a positive and a negative portion of the analog image signal; amplifying the positive portion of the analog image signal; amplifying the negative portion of the analog image signal; and combining, in response to the polarity control signal, the positive and negative portions of the analog image signal to form the source line driving signal.

In another exemplary embodiment of the present invention the positive and negative portions of the analog image signal are amplified relative to a common voltage.

According to an embodiment of the present invention, since the source driver described above comprises the logic circuit using the existing polarity control signal without detecting the output of the source line driving signal so as to control the repair amplifier, power consumption can be reduced and the repair source line driving signal can be more rapidly generated.

BRIEF DESCRIPTION OF THE DRAWINGS

The above and features of the present invention will become more apparent from the detailed description of exemplary embodiments thereof with reference to the attached drawings in which.

DETAILED DESCRIPTION OF PREFERRED EMBODIMENTS

Figure 1:
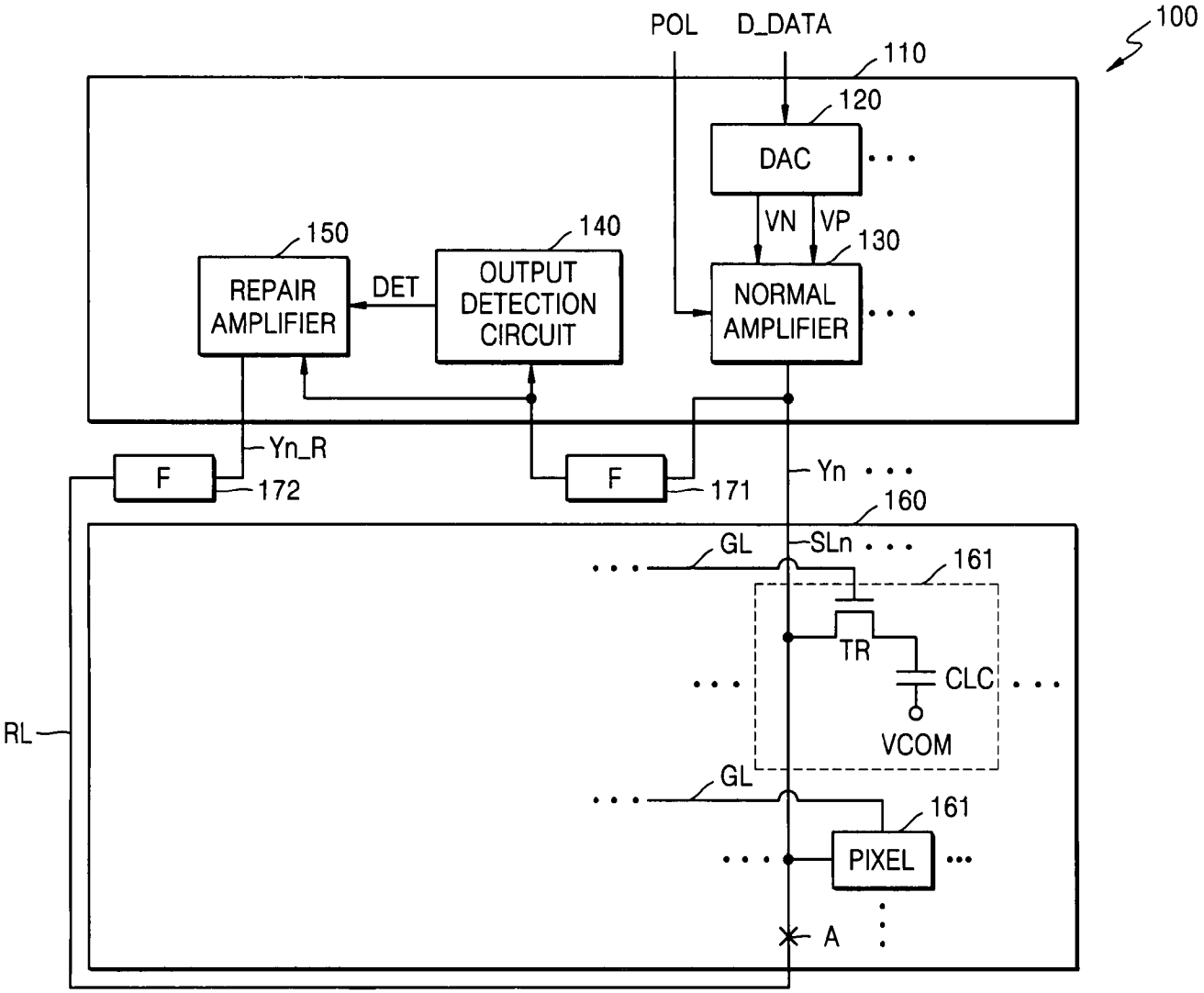
FIG. 1 (PRIOR ART)
FIG. 1 is a block diagram schematically illustrating a conventional liquid crystal display device.
Figure 2:
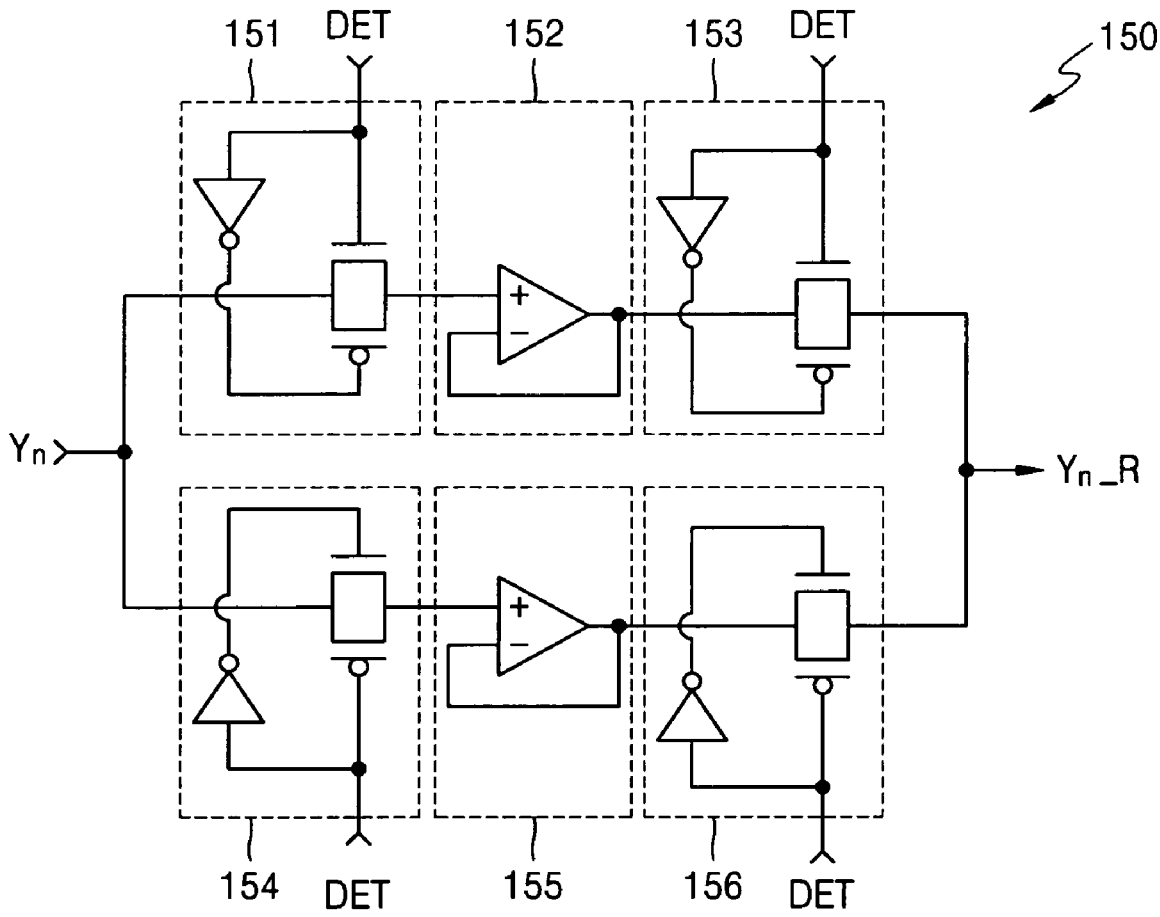
FIG. 2 (PRIOR ART)
FIG. 2 is a circuit diagram illustrating an example of the repair amplifier shown in FIG. 1.
Figure 3:
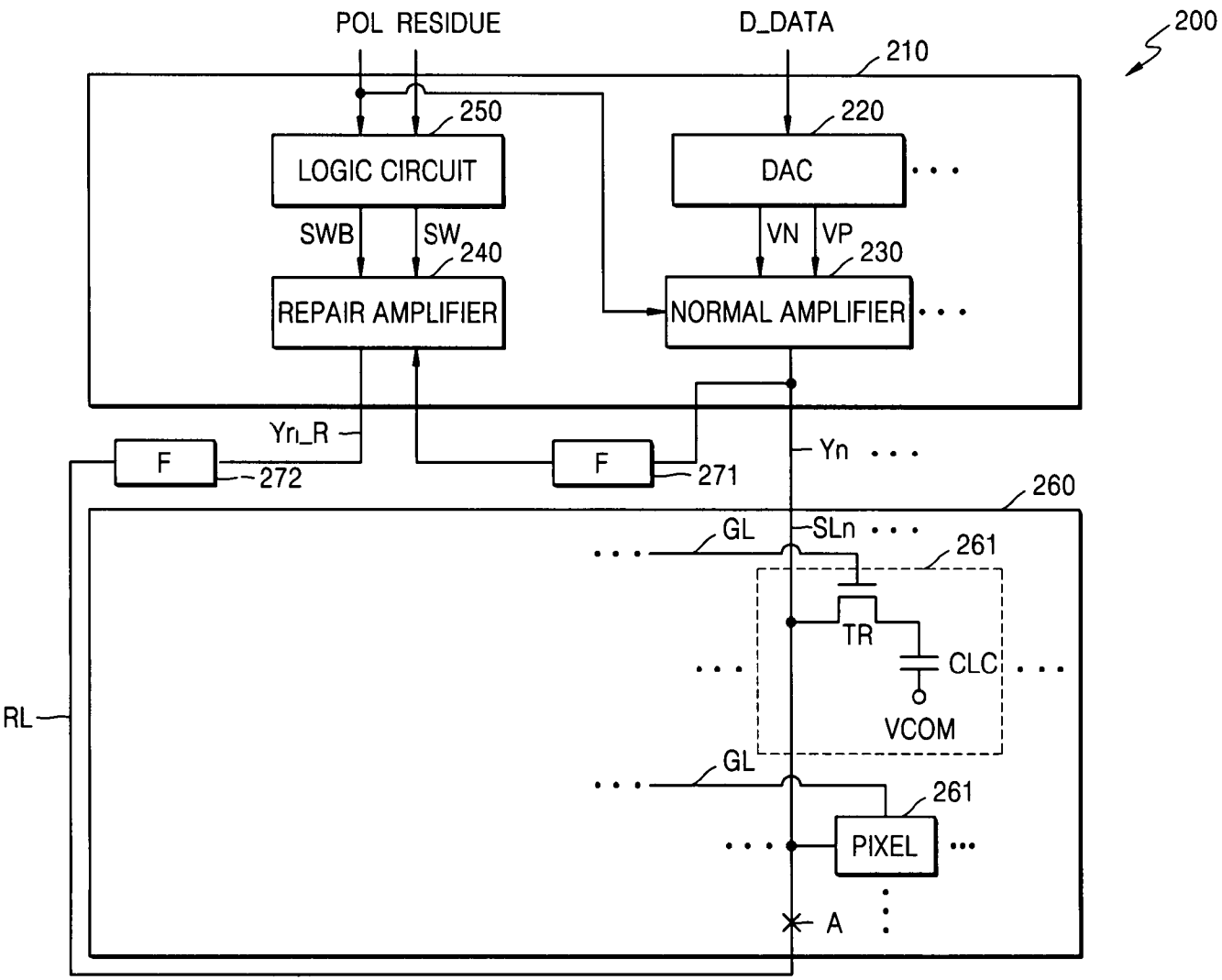
FIG. 3 is a block diagram schematically illustrating a liquid crystal display device according to an exemplary embodiment of the present invention.

FIG. 3 is a block diagram schematically illustrating a liquid crystal display device in accordance with an exemplary embodiment of the present invention. The liquid crystal display device 200 comprises a source driver 210, a liquid crystal panel 260, a first fuse (F) 271 and a second fuse (F) 272.

The exemplary source driver 210 comprises digital-to-analog converters (DAC) 220, normal amplifiers 230, a repair amplifier 240 and a logic circuit 250.

A plurality of digital-to-analog converters 220 and a plurality of normal amplifiers 230 are arranged in the source driver 210, and source line driving signals which are outputs of the normal amplifiers 230 may be, for example, $Y_{n-1}$ or $Y_{n+1}$ (not shown). The $Y_{n-1}$ and $Y_{n+1}$ are generated by an inverted signal of a polarity control signal POL and are inverted signals of an n-th source line driving signal $Y_n$.

Each DAC 220 converts digital image signal D_DATA into analog image signals (VP and VN) and outputs the converted signals. The analog image signals VP and VN indicate a gray level voltage.

Each normal amplifier 230 amplifies the analog image signals (VP and VN) in response to the polarity control signal POL and generates the source line driving signal $Y_n$ that drives source line $SL_n$ of the liquid crystal panel 260. The polarity control signal POL is a signal controlling the polarity of liquid crystal. It can be inverted every frame to prevent deterioration of the liquid crystal panel 260. An exemplary source line driving method using the normal amplifiers 230 is a column inversion method in which adjacent source lines are driven with the source line driving signals having a mutually inverted phase. Each normal amplifier 230 can be implemented as a single amplifier or a rail-to-rail amplifier.

Referring still to FIG. 3, when an open-circuit defect A is generated in the source line $SL_n$ because of errors in the manufacturing of the liquid crystal panel 260, the first and second fuses 271 and 272 are melted by a laser to connect metal lines arranged at both ends of the first and second fuses 271 and 272.

In another exemplary embodiment of the present invention open-circuits may be generated in four source lines of a total eight source lines. In this case, four repair amplifiers 240, four logic circuits 250, four first fuses 271, four second fuses 272 and four repair lines RL may be required.

Referring to the exemplary embodiment of FIG. 3 repair amplifier 240 amplifies the source line driving signal $Y_n$, transmitted through the first melted fuse 271, in response to a switch signal SW and an inverted signal SWB of the switch signal SW. The repair amplifier 240 also generates a repair source line driving signal $Y_n$_R. The repair source line driving signal $Y_n$_R drives, through the repair line RL, the part of a source line $SL_n$ that is not driven due to the open-circuit defect A; the phase of $Y_n$_R is equal to the phase of the polarity control signal POL. The adjacent (n−1)-th or (n+1)-th repair source line driving signal $Y_{n-1}$_R or $Y_{n+1}$_R, not shown in FIG. 3, is an inverted signal of the n-th repair source line driving signal $Y_n$_R, and the phase thereof is opposite to the phase of the polarity control signal POL. That is, the phase difference between $Y_{n-1}$_R (or $Y_{n+1}$_R ) and PLO is 180 degrees.

The logic circuit 250 generates the switch signal SW and the inverted signal SWB of the switch signal SW in response to the polarity control signal POL and an external control signal RESIDUE. The external control signal RESIDUE is applied from outside the source driver 210.

In the exemplary embodiment depicted in FIG. 3 the phase of the switch signal SW may be equal or opposite to the phase of the polarity control signal POL in accordance with a logic state of the external control signal RESIDUE. That is, when the external control signal RESIDUE has a low level, the phase of the switch signal SW is equal to the phase of the polarity control signal POL. The n-th repair source line driving signal $Y_n$_R is generated from the switch signal SW. The adjacent (n−1)-th or (n+1)-th repair source line driving signal $Y_{n-1}$_R or $Y_{n+1}$_R is an inverted signal of the n-th repair source line driving signal $Y_n$_R, and is generated from the switch signal SW based on the external control signal RESIDUE of a high level. That is, when the external control signal RESIDUE has a high level, the phase of the switch signal SW is opposite to the phase of the polarity control signal POL.

Therefore, since the source driver 210 according to an exemplary embodiment of the present invention comprises the logic circuit 250 using the existing polarity control signal POL without detecting outputs of the source line driving signals $Y_{n-1}$, $Y_n$ and $Y_{n+1}$ the power consumption can be further reduced and repair source line driving signals $Y_{n-1}$_R, $Y_n$_R and $Y_{n+1}$_R can be generated more rapidly as compared with the conventional source driver. In addition, since a liquid crystal display device 200 according to the present invention comprises the above source driver, power consumption can be reduced and stable images can be displayed.

An exemplary liquid crystal panel 260 comprises a plurality of pixels 261. Each pixel 261 has a switch transistor TR and a liquid crystal capacitor CLC. The switch transistor TR is turned on or turned off in response to a signal driving a gate line GL, and one end of the switch transistor TR is connected to source lines $SL_n$. The liquid crystal capacitor CLC is connected between the other end of the switch transistor TR and a common voltage VCOM. For example, the common voltage VCOM may be VDD/2.

Figure 4:
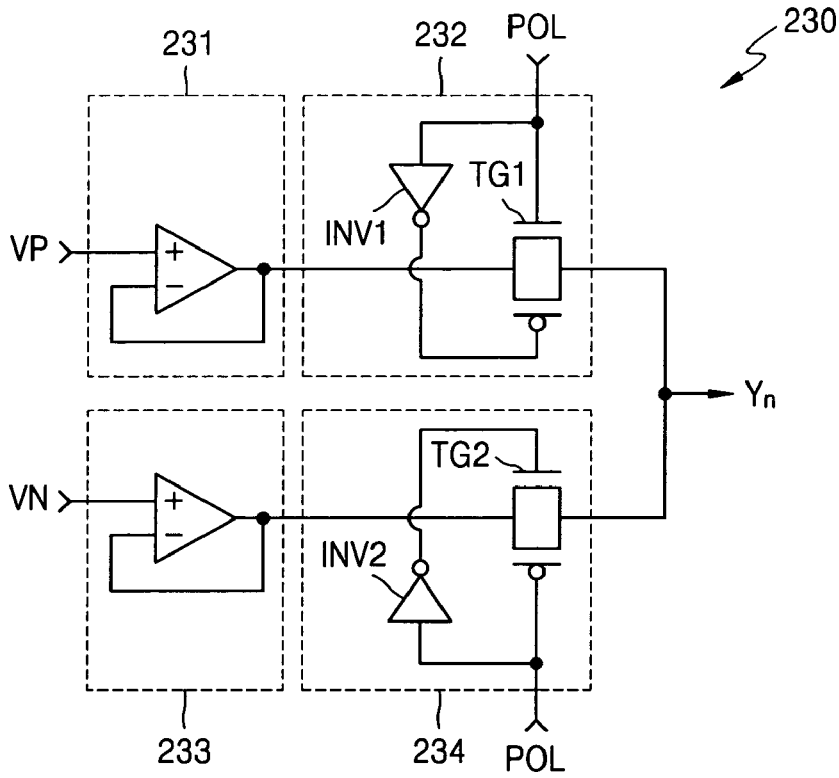
FIG. 4 is a circuit diagram illustrating in more detail an exemplary embodiment of the normal amplifier shown in FIG. 3.

FIG. 4 is a circuit diagram illustrating in more detail an exemplary embodiment of the normal amplifier shown in FIG. 3, in accordance with the present invention. Referring to FIG. 4, the normal amplifier 230 comprises a charging amplifier 231, a discharging amplifier 233 and switch circuits 232 and 234. The charging amplifier 231 and the discharging amplifier 233 constitute a single amplifier.

The charging amplifier 231 can be implemented with an operational amplifier configured as a voltage follower. The charging amplifier 231 amplifies a positive voltage VP of an analog image signal and transmits the amplified positive voltage to the first switch circuit 232.

The discharging amplifier 233 can be implemented with an operational amplifier configured as a voltage follower. The discharging amplifier 233 amplifies a negative voltage VN of the analog image signal and transmits the amplified negative voltage to the second switch circuit 234.

The first switch circuit 232 comprises an inverter INV1 and a transmission gate TG1. The first switch circuit 232 is turned on in response to the polarity control signal POL of a high level and supplies the positive voltage VP amplified by the charging amplifier 231 to the source line driving signal $Y_n$.

The second switch circuit 234 comprises an inverter INV2 and a transmission gate TG2. The second switch circuit 234 is turned on in response to the polarity control signal POL of a low level and supplies the negative voltage VN amplified by the discharging amplifier 233 to the source line driving signal $Y_n$.

Figure 5:
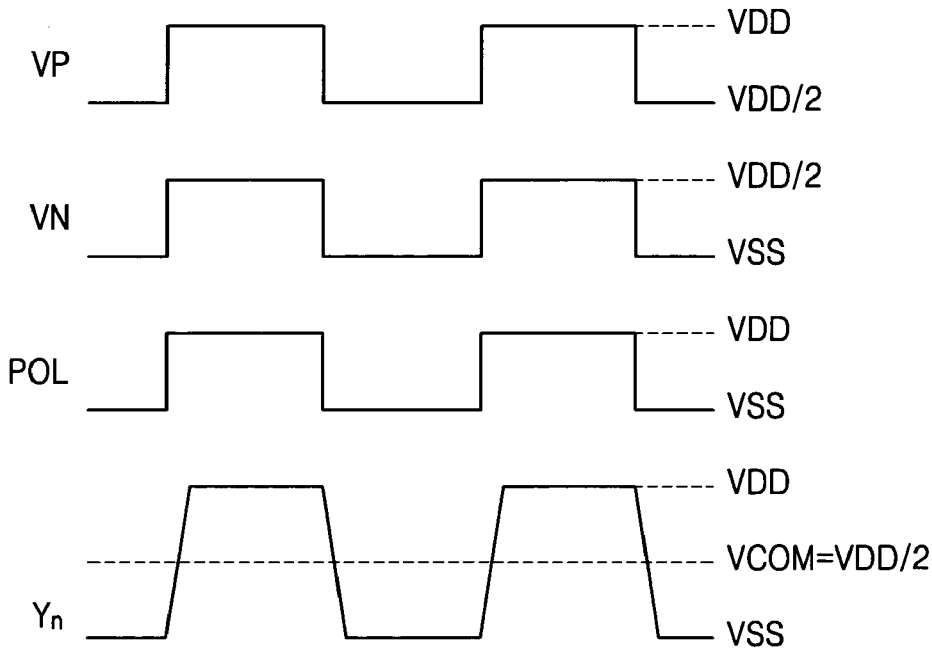
FIG. 5 is an exemplary timing diagram illustrating an operation of the normal amplifier shown in FIG. 4.

FIG. 5 is an exemplary timing diagram illustrating an operation of the normal amplifier shown in FIG. 4.

The operation of the normal amplifier 230 will be described with reference to FIGS. 4 and 5. The charging amplifier 231 amplifies the periodic positive voltage VP, and the discharging amplifier 233 amplifies the periodic negative voltage VN. At that time, when the switch circuits 232 and 234 are turned on in accordance with a high level and a low level, respectively, of the polarity control signal POL. The source line driving signal $Y_n$ is periodically generated from the amplified positive voltage VP and the amplified negative voltage VN. In the source line driving signal $Y_n$, a voltage larger than the common voltage VCOM ( equal to VDD/2 in this case) indicates a positive voltage, and a voltage smaller than the common voltage VCOM indicates a negative voltage.

Another exemplary embodiment of a normal amplifier, in accordance with the present invention, can be implemented as follows. This normal amplifier can, be used to generate the source line driving signals ($Y_{n-1}$ and $Y_{n+1}$) driving the adjacent source lines of the source line $SL_n$ (depicted in FIG. 3). It can be implemented by connecting the charging amplifier 231 to the second switch circuit 234 and connecting the discharging amplifier 233 to the first switch circuit 232.

This exemplary embodiment of a normal amplifier can generate the inverted signal $Y_{n-1}$ or $Y_{n+1}$ of the source line driving signal $Y_n$. In this case, the phase of the inverted signal $Y_{n-1}$ or $Y_{n+1}$ of the source line driving signal $Y_n$ is opposite to the phase of the polarity control signal POL.

Figure 6:
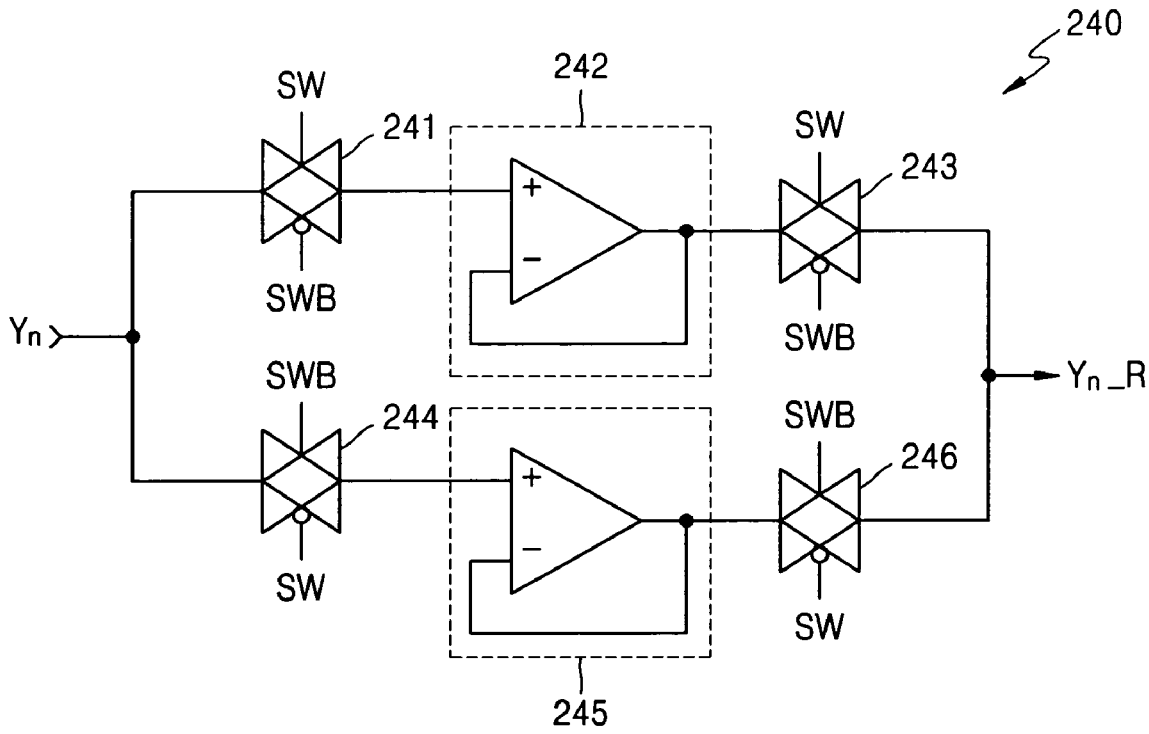
FIG. 6 is a circuit diagram illustrating in more detail an exemplary embodiment of the repair amplifier shown in FIG. 3.

FIG. 6 is a circuit diagram illustrating in more detail an exemplary embodiment of the repair amplifier shown in FIG. 3, in accordance with the present invention. The repair amplifier 240 comprises switch circuits 241, 243, 244 and 246. It also comprises a charging amplifier 242 and a discharging amplifier 245. The charging amplifier 242 and the discharging amplifier 245 constitute a single amplifier. Each of the switch circuits 241, 243, 244 and 246 comprises a transmission gate.

The switch circuits 241 and 243, connected to the input and output terminals of the charging amplifier 242, are turned on in response to a switch signal SW of a high level and an inverted signal SWB, of the switch signal SW, where the inverted signal SWB has a low level.

The charging amplifier 242 can be implemented with an operational amplifier configured as a voltage follower. The charging amplifier 242 amplifies a positive voltage of the source line driving signal $Y_n$, transmitted from the first switch circuit 241, and supplies the amplified positive voltage to the repair source line driving signal $Y_n$_R transmitted to the second switch circuit 243.

The switch circuits 244 and 246 connected to the input and output terminals of the discharging amplifier 245 are turned on in response to the inverted signal SWB of the switch signal SW and the switch signal SW of a low level, where the inverted signal SWB has a high level.

The discharging amplifier 245 can be implemented with an operational amplifier configured as a voltage follower. The discharging amplifier 245 amplifies a negative voltage of the source line driving signal $Y_n$, transmitted from the third switch circuit 244, and supplies the amplified negative voltage to the repair source line driving signal $Y_n$_R transmitted to the fourth switch circuit 246.

The phase of the repair source line driving signal $Y_n$_R is equal to the phase of the polarity control signal POL. On the other hand, although not shown in FIG. 6, the phase of the repair source line driving signal $Y_{n-1}$_R or $Y_{n+1}$_R is opposite to the phase of the polarity control signal POL.

Figure 7:
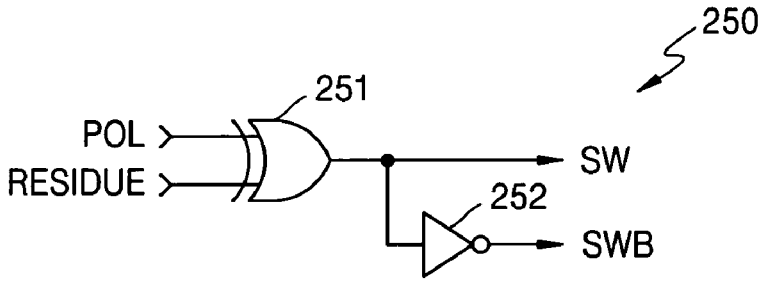
FIG. 7 is a circuit diagram illustrating in more detail an exemplary embodiment of the logic circuit shown in FIG. 3.

FIG. 7 is a circuit diagram illustrating in more detail an exemplary embodiment of the logic circuit shown in FIG. 3, in accordance with the present invention. The logic circuit 250 comprises an exclusive OR (XOR) gate 251 and an inverter 252.

The XOR gate 251 generates the switch signal SW in response to the polarity control signal POL and the external control signal RESIDUE. The inverter 252 generates the inverted signal SWB of the switch signal SW.

When the external control signal RESIDUE is at a low level, the switch signal SW that is generated has a phase equal to the phase of the polarity control signal POL. Thus, the n-th repair source line driving signal $Y_n$_R is generated from the switch signal SW. However, when the external control signal RESIDUE is at a high level, the switch signal SW that is generated has a phase opposite to the phase of the polarity control signal POL. Thus, the (n−1)-th repair source line driving signal $Y_{n-1}$_R or the (n+1)-th repair source line driving signal $Y_{n+1}$_R is generated from the switch signal SW. Therefore, the phases of the adjacent repair source line driving signals are opposite to each other.

While the present invention has been particularly shown and described with reference to exemplary embodiments thereof, it will be understood by those skilled in the art that various changes in form and details may be made therein without departing from the spirit and scope of the present invention as defined by the appended claims.

What is claimed is:

1. A source driver of a liquid crystal display device that drives adjacent source lines with source line driving signals having a mutually inverted phase relationship, the source driver comprising:

a normal amplifier that amplifies an analog image signal and generates a source line driving signal that drives one of the source lines in response to a polarity control signal;

a logic circuit that generates at least one of a switch signal and an inverted signal of the switch signal in response to the polarity control signal and an external control signal; and a repair amplifier that, when connected to the source line driving signal, amplifies the source line driving signal, in response to the at least one of the switch signal and the inverted signal of the switch signal, to generate a repair source line driving signal that drives a repair line, wherein the repair line is connected to a part of the source line that is not driven by the source line driving signal due to a defect of the source line.

2. A source driver of claim 1, wherein the logic circuit generates both the switch signal and the inverted signal of the switch signal in response to the polarity control signal and the external control signal, wherein the phase of the switch signal is equal or opposite to the phase of the polarity control signal in response to the logic state of the external control signal.

3. A source driver of claim 2, wherein the phase of the switch signal is equal to the phase of the polarity control signal when the external control signal has a logic low level, and the phase of the switch signal is opposite to the phase of the polarity control signal when the external control signal has a logic high level, whereby the repair source line driving signal is generated to have the opposite phase of the switch signal.

4. A source driver of claim 3, wherein the repair amplifier comprises:

a charging amplifier that amplifies a positive voltage of the source line driving signal and supplies the amplified positive voltage to the repair source line driving signal; and a discharging amplifier that amplifies a negative voltage of the source line driving signal and supplies the amplified negative voltage to the repair source line driving signal.

5. A source driver of claim 4, wherein the repair amplifier further comprises:

a first switch circuit that transmits the positive voltage of the source line driving signal to an input terminal of the charging amplifier in response to the switch signal;

a second switch circuit that supplies the amplified positive voltage to the repair source line driving signal in response to the switch signal;

a third switch circuit that transmits the negative voltage of the source line driving signal to an input terminal of the discharging amplifier in response to the inverted signal of the switch signal; and a fourth switch circuit that supplies the amplified negative voltage to the source line driving signal in response to the inverted signal of the switch signal.

6. A source driver of claim 5, wherein each of the switch circuits includes a transmission gate.

7. A source driver of claim 6, wherein the logic circuit comprises:

an exclusive OR gate that generates the switch signal in response to the polarity control signal and the external control signal; and an inverter that inverts the switch signal to generate the inverted signal of the switch signal.

8. A source driver of claim 7, wherein each of the charging amplifiers and the discharging amplifiers comprises an operational amplifier configured as a voltage follower.

9. A source driver of claim 3, wherein the normal amplifier comprises:

a charging amplifier that amplifies a positive voltage of the analog image signal;

a discharging amplifier that amplifies a negative voltage of the analog image signal;

a first switch circuit that supplies the amplified positive voltage to the source line driving signal in response to the polarity control signal; and a second switch circuit that supplies the amplified negative voltage to the source line driving signal in response to the polarity control signal.

10. A source driver of claim 9, wherein each of the charging amplifiers and the discharging amplifiers comprises an operational amplifier configured as a voltage follower.

11. The source driver according to claim 10, wherein each of the first and second switch circuits comprises a transmission gate and an inverter.

12. A source driver of claim 1, wherein the repair amplifier comprises a single amplifier.

13. A liquid crystal display device, comprising:

a liquid crystal panel having a plurality of pixels connected to a plurality of source lines;

a source driver that produces a plurality of source line driving signals to drive the plurality of source lines so that adjacent source lines are driven with the source line driving signals having a mutually inverted phase relationship; and a logic circuit that generates at least one of a switch signal and an inverted signal of the switch signal in response to a polarity control signal and an external control signal, wherein the source driver comprises a repair amplifier that, when connected to one of the plurality of source line driving signals that drives a defective one of the plurality of source lines and the defective source line, drives the pixels connected to a part of the defective source line that is not driven by the one of the source line driving signals, wherein the repair amplifier is controlled by at least one of the switch signal and the inverted signal of the switch signal that also controls a polarity inversion of a liquid crystal corresponding to one of the pixels.

14. A method of driving a liquid crystal panel using adjacent source lines and source line driving signals that have a mutually inverted phase relationship, comprising:

providing a source line driving signal that drives a source line;

receiving at least one of a switch signal and an inverted signal of the switch signal; which is generated in response to a polarity control signal and an external control signal; and processing the source line driving signal, in response to at least one of the switch signal and the inverted signal of the switch signal, to generate a repair source line driving signal that is used to drive a part of the source line, wherein the part of the source line is not driven by the source line driving signal due to a defect of the source line.

15. A method of claim 14, wherein the switch signal and the inverted signal of the switch signal, are generated in response to the polarity control signal and the external control signal so the phase of the switch signal is equal or opposite to the phase of the polarity control signal in response to a logic state of the external control signal.

16. A method of claim 15, wherein the switch signal is generated using explosive OR logic to process the polarity control signal and the external control signal.

17. A method of claim 14, wherein the step of processing the source line driving signal comprises:

amplifying a positive portion of the source line driving signal;

amplifying a negative portion of the source line driving signal; and combining the amplified positive and negative portions to generate the repair source line driving signal.

18. A method of claim 14, wherein the step of providing a source line driving signal comprises: amplifying an analog image signal in response to a polarity control signal; and outputting the source line driving signal.

19. A method of claim 18, wherein the step of amplifying an analog image signal comprises:

receiving a positive and a negative portion of the analog image signal;

amplifying the positive portion of the analog image signal;

amplifying the negative portion of the analog image signal; and combining, in response to the polarity control signal, the positive and negative portions of the analog image signal to form the source line driving signal.

20. A method of claim 19, wherein the positive and negative portions of the analog image signal are amplified relative to a common voltage.

* * * * *